US005559411A

United States Patent [19]

Winship

[11] Patent Number: 5,559,411

[45] Date of Patent: Sep. 24, 1996

[54] NONFRICTION POWER SYSTEM FOR EXTENDING/RETRACTING A STRUCTURE

[75] Inventor: David W. Winship, Effingham, Ill.

[73] Assignee: Irwin Seating Company, Grand Rapids, Mich.

[21] Appl. No.: 385,663

[22] Filed: Feb. 7, 1995

[51] Int. Cl.[6] ..... E04H 3/12

[52] U.S. Cl. ..... 318/466; 52/10; 52/118; 297/16.2; 297/232; 297/331

[58] Field of Search ..... 318/264, 265, 318/266, 286, 466, 467, 468; 52/6, 8, 9, 10, 111, 116, 117, 118, 121; 297/14, 15, 16.1, 16.2, 232, 234, 235, 236, 240, 243, 311, 313, 316, 331, 332, 334, 340, 378.1

[56] References Cited

U.S. PATENT DOCUMENTS

| | | | |
|---|---|---|---|
| 771,233 | 10/1904 | Davidson . | |
| 1,307,559 | 6/1919 | McNeilly . | |
| 1,836,815 | 12/1931 | Reeves . | |
| 2,255,908 | 9/1941 | Anderson . | |
| 2,368,848 | 2/1945 | Krueger . | |
| 2,481,471 | 9/1949 | Crot . | |
| 2,550,120 | 4/1951 | Martin . | |
| 2,568,290 | 9/1951 | Mountain et al. . | |
| 2,639,623 | 5/1953 | Ausherman . | |
| 2,702,674 | 2/1955 | Willson et al. . | |
| 2,946,556 | 7/1960 | Edgerton, Jr. . | |
| 2,990,587 | 7/1961 | Murphy . | |
| 3,178,154 | 4/1965 | McClelland . | |
| 3,738,612 | 6/1973 | Hartman . | |
| 3,881,140 | 4/1975 | Hartman . | |
| 4,043,208 | 8/1977 | Losing . | |
| 4,285,172 | 8/1981 | Quigley | 52/10 |
| 4,745,714 | 5/1988 | Matsutani . | |

OTHER PUBLICATIONS

"Folding Bleacher Co." product brochure. Folding Bleacher Co., a subsidiary of Irwin Seating Co., publisher. Published prior to Feb. 7, 1994.

"Safway Spectator Seating" product brochure. Safway Steel Products, Inc., Milwaukee, WI, publisher. Published prior to Feb. 7, 1994.

"Wayne Gymnasium Seating" product brochure. Wayne Iron Works, Wayne, PA, publisher. Published prior to Feb. 7, 1994.

"Accuroll/75 Folding Seating" product brochure. Universal Bleacher Co., Champaign, IL, publisher. Published prior to Feb. 7, 1994.

"Telescopic Seating Systems—Interkal 1991" product brochure. Interkal Inc., Kalamazoo, MI, publisher. Published prior to Feb. 7, 1994.

*Primary Examiner*—Bentsu Ro

*Attorney, Agent, or Firm*—Van Dyke, Gardner, Linn & Burkhart, LLP

[57] ABSTRACT

A power system is provided for extending and retracting telescopic seating. The power system includes a frame, a drum operably mounted on the frame for rotational and translational movement, and an extendable chain having a first end operably attached to the telescopic seating and a second end operably attached to the drum. A power mechanism is configured to rotate the drum to wrap the extendable chain onto the drum and further is configured to raise the drum as the extendable chain is wound onto the .drum and takes up space thereon. Still further, the power mechanism is configured to lower the drum as the extendable chain is unwound from the drum and takes up less space thereon. The extendable chain includes interconnected links with wheels that mateably nest adjacent each other in alternating positions as the chain is wound onto the drum.

38 Claims, 6 Drawing Sheets

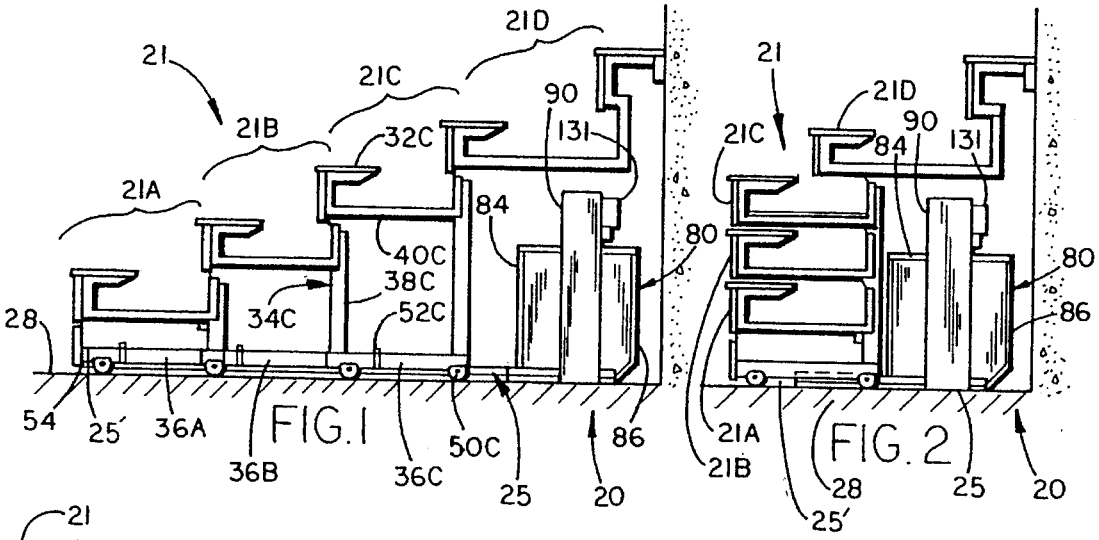
FIG. 1
FIG. 2
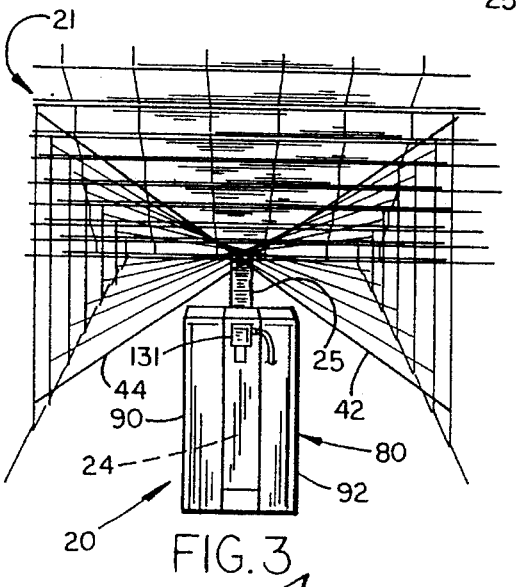
FIG. 3
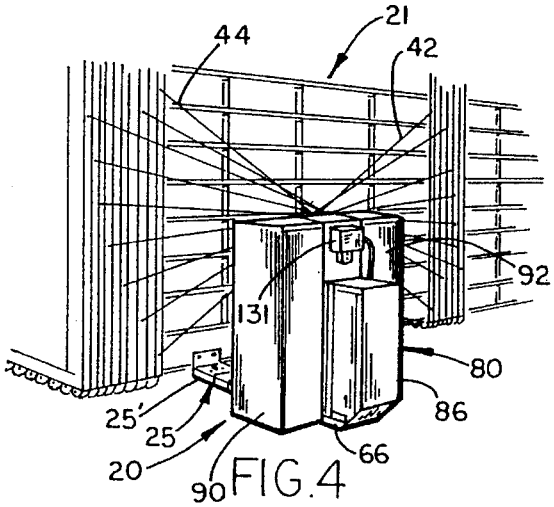
FIG. 4
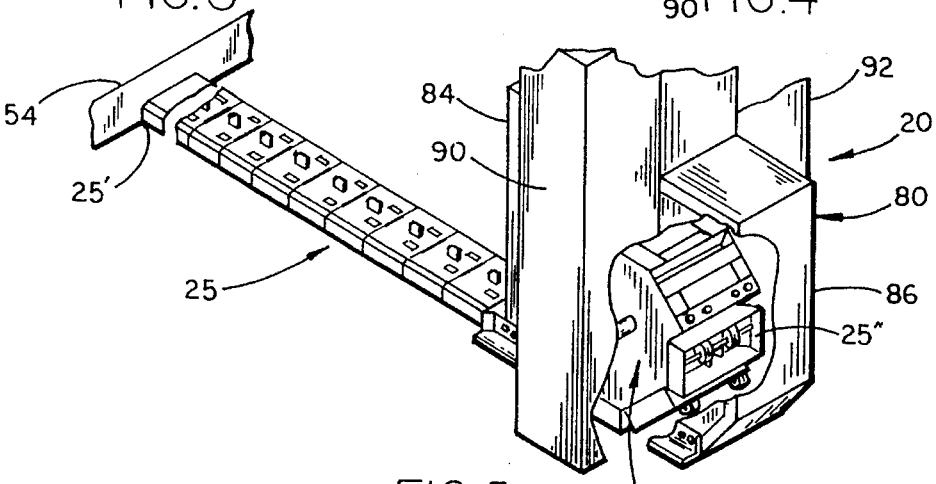
FIG. 5

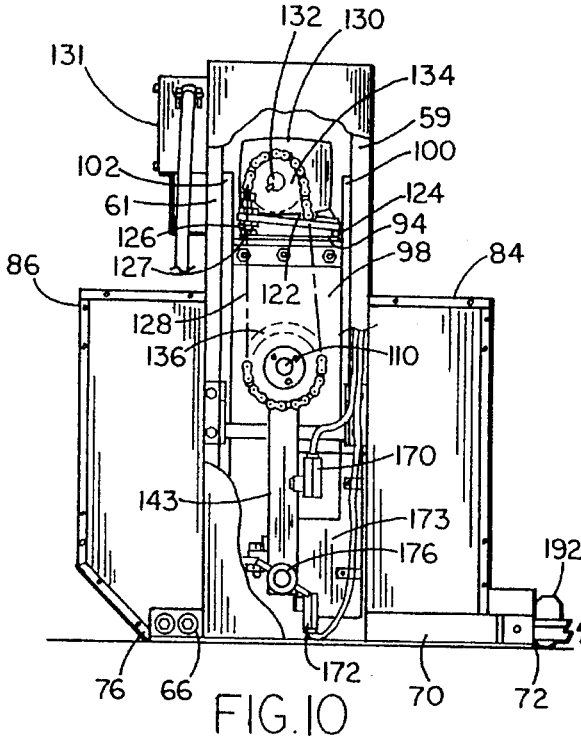
FIG. 10
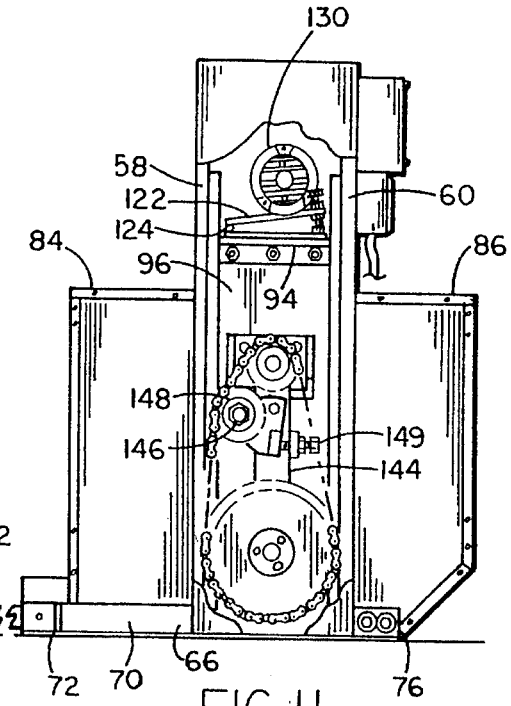
FIG. 11
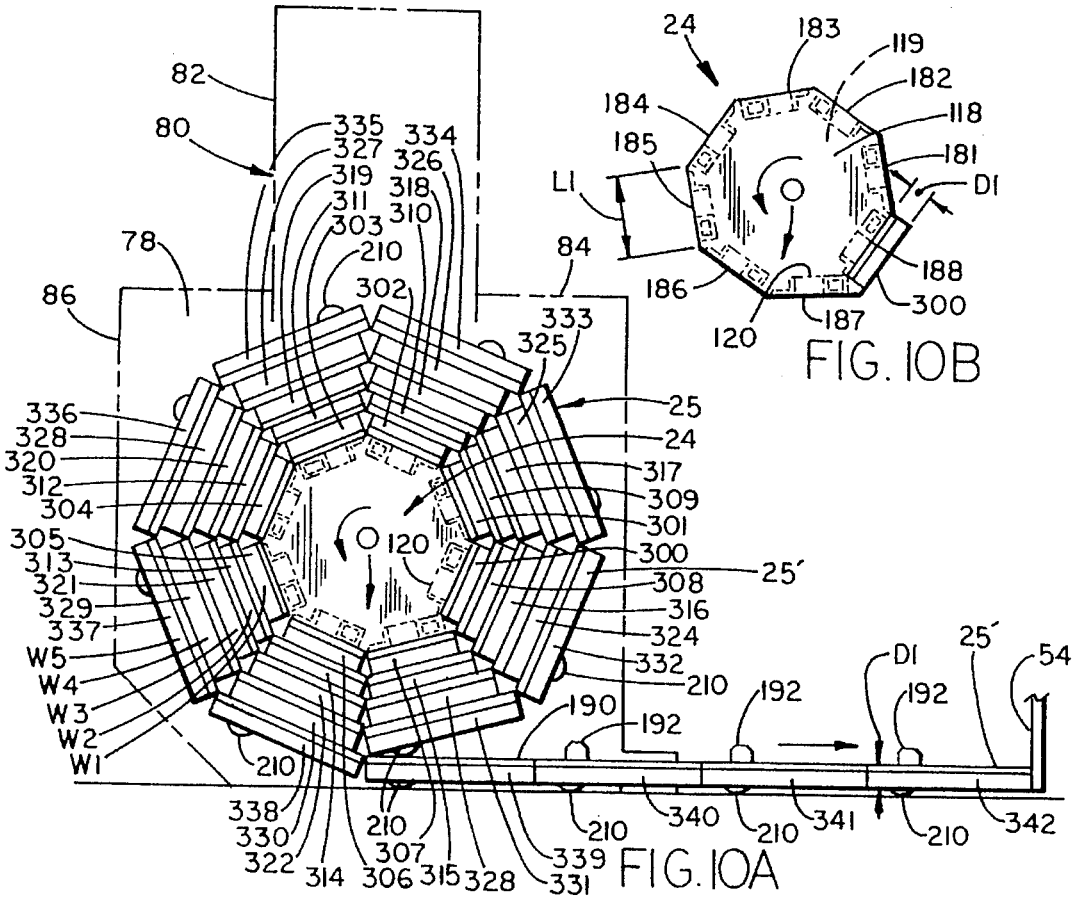
FIG. 10A
FIG. 10B

NONFRICTION POWER SYSTEM FOR EXTENDING/RETRACTING A STRUCTURE

BACKGROUND OF THE INVENTION

The present invention concerns nonfriction power systems, and more particularly concerns a nonfriction positive drive power system useful for extending and retracting telescopic seating and the like.

Known power systems for extending and retracting telescopic seating, such as for bleacher systems, are of two major types—friction drive systems and nonfriction drive systems. Friction drive systems include a drive wheel that frictionally engages a floor surface to move the telescopic seating. However, friction drive systems are not reliable where the floor is likely to be dirty or where liter or debris may fall onto the floor since the drive wheel will periodically lose frictional contact with the floor and spin. Nonfriction drive systems do not frictionally engage the floor, but instead include an extendable chain that extends from a power drive mechanism positioned at the rear of the telescopic seating structure. However, nonfriction drive systems tend to be relatively large, bulky and expensive. Further, the extendable chains, if not properly adjusted, can cause the telescopic seating to extend non-linearly. This condition can cause the extendable chain and/or the telescopic seating to skew, resulting in alignment difficulties. Under extreme conditions non-linear extension may cause the chain to deform, particularly at the outermost end of the chain where the chains are the weakest and experience the greatest stress. Known extendable chains and the mechanisms for driving them also tend to be quite complex and sensitive to wear, such that they require constant maintenance and adjustment to keep them in proper working condition. "Beefing up" the extendable chains and increasing the power of the drive system is generally unsatisfactory since it adds cost and bulk, and does not solve the underlying problems relating to poor distribution of stress.

Thus, a power system for extending and retracting a structure solving the aforementioned problems is desired.

SUMMARY OF THE INVENTION

The invention includes a power system for extending and retracting telescopic seating systems. The power system includes a frame, a drum operably supported on the frame for rotational and vertical, translational movement, and an extendable chain adapted to extend and retract telescopic seating operably connected to the drum. A power mechanism is mounted on the frame and operably connected to the drum to rotate the drum to selectively extend and retract the extendable chain. The chain has a thickness such that successive wraps of the chain on the drum have an increased diameter, but the power mechanism is configured to raise and lower the drum as the extendable chain is retracted and extended, respectively, so that an extended portion of the chain is substantially continuously tangentially aligned with the wound portion of the chain on the drum.

These and other features, advantages and objects of the present invention will be further understood and appreciated by those skilled in the art by reference to the following specification, claims and appended drawings.

BRIEF DESCRIPTION OF THE DRAWINGS

FIG. 1 is a side view of a power system embodying the present invention, the power mechanism being operably connected to telescopic seating for selectively extending and retracting the seating, the telescopic seating and extendable chain being shown in the extended position;

FIG. 2 is a side view of the power system and telescopic seating shown in FIG. 1, the seating being shown in a closed position;

FIG. 3 is a rear fragmentary perspective view of the power system and telescopic seating shown in FIG. 1;

FIG. 4 is a rear fragmentary perspective view of the power system and telescopic seating shown in FIG. 2;

FIG. 5 is a fragmentary rear perspective view, partially broken away, of the power system shown in FIG. 3, the extendable chain being almost fully extended;

FIG. 10 is a right side elevational view, partially broken away, of the power system shown in FIG. 6;

FIG. 10A is a side elevational schematic view of the extendable chain wound substantially fully onto the drum;

FIG. 10B is a side elevational view of the drum;

FIG. 11 is a left side elevational view, partially broken away, of the power system shown in FIG. 6;

DETAILED DESCRIPTION OF PREFERRED EMBODIMENT

Figure 5A:
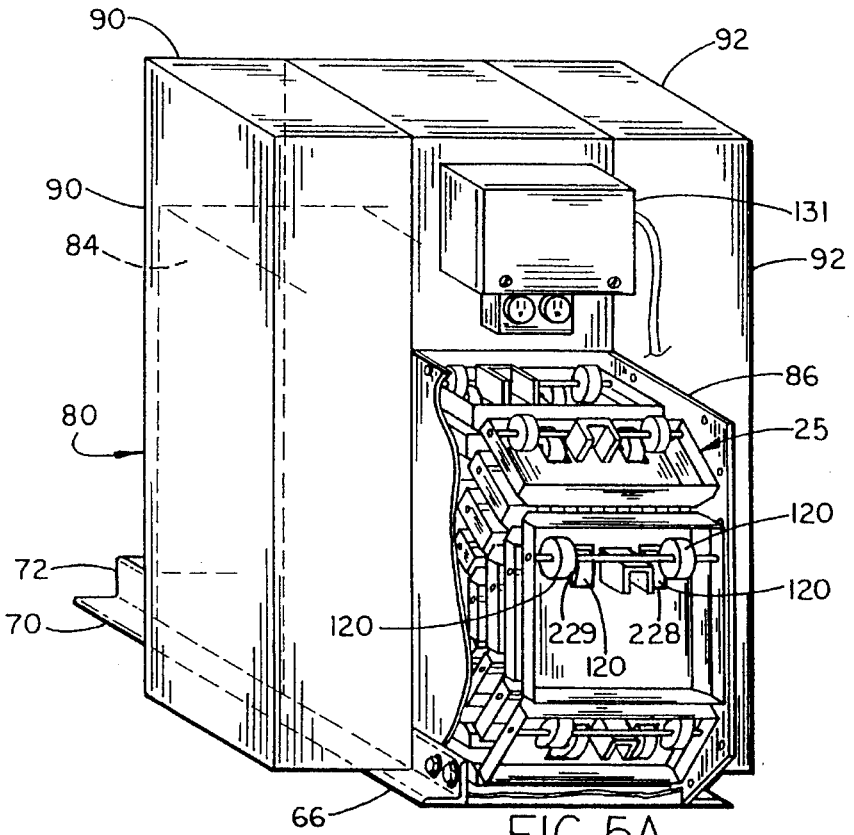
FIG. 5A is an enlarged rear perspective view, partially broken away, of the power system shown in FIG. 5, the extendable chain being substantially fully retracted and wound onto the drum.
Figure 9:
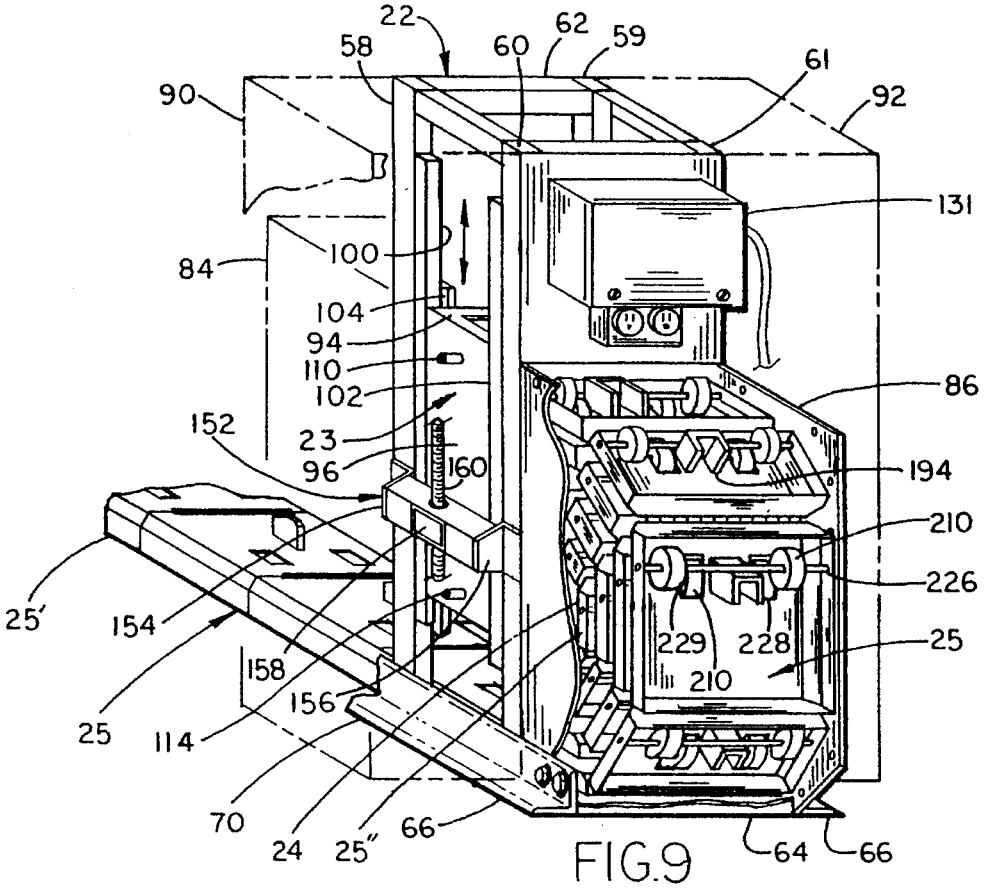
FIG. 9 is a rear perspective view of the power system, partially in cross section as taken generally along the plane IX—IX in FIG. 6 and partially broken away, the side covers being shown in phantom lines.
Figure 6:
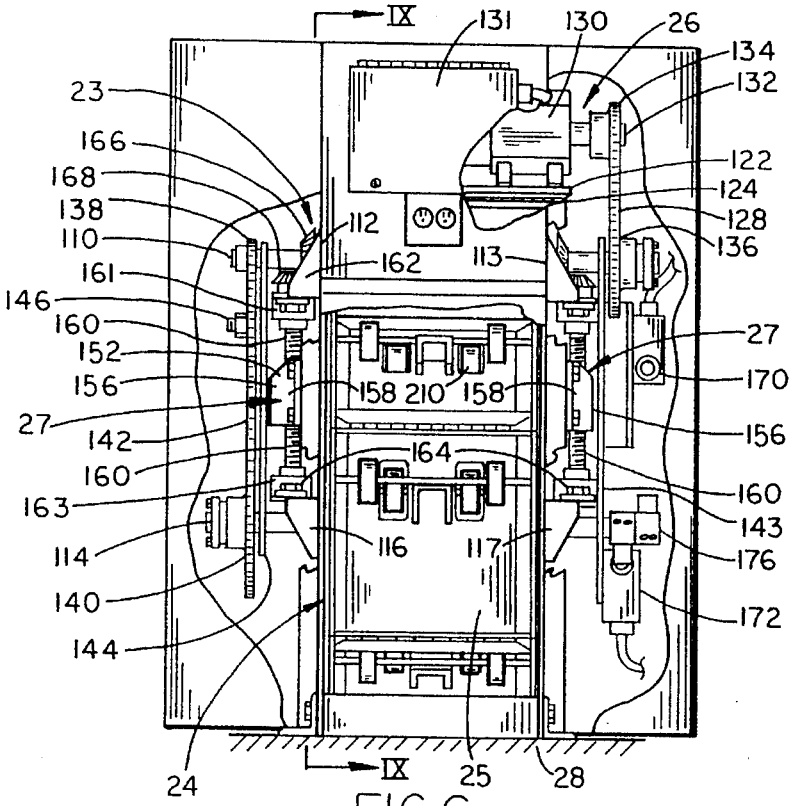
FIG. 6 is a rear elevational view, partially broken away, of the power system shown in FIG. 5A including the power mechanism for lifting and rotating the drum.

A power system 20 (FIGS. 1–5) embodying the present invention is provided for extending and retracting telescopic or folding seating 21. The power system 20 (FIG. 9) includes a frame 22, a carrier 23 operably mounted on frame 22 for vertical translational movement, and a drum 24 operably mounted on carrier 23 for rotational movement. An extendable chain 25 is secured at its first end 25' to the telescopic seating 21 (FIG. 1) and is secured at its second end 25" to the drum 24. The power system 20 includes a power mechanism 26 (FIG. 6) configured to selectively rotate drum 24 and wrap/unwrap the extendable chain 25 on drum 24. Power mechanism 26 includes a lift mechanism 27 configured to raise carrier 23 and drum 24 at a predetermined rate as the extendable chain 25 is wound onto drum 24 and takes up space thereon, and to lower the carrier 23 and drum 24 as the extendable chain 25 is unwound from the drum 24 and takes up less space thereon. Thus, an extended portion of the extendable chain 25 is continuously extended along a predetermined, horizontal line along the floor 28 (FIG. 1) tangentially to the portion of extendable chain 25 wound onto drum 24. This arrangement provides a power system 20 that is compact, energy efficient, requires low maintenance, and further which provides an optimal distribution of stress.

Telescopic seating 21 (FIGS. 1–5) includes a plurality of sections 21A, 21B, 21C and etc. operably interconnected for telescopingly collapsible movement. In FIGS. 1–2, only four seating sections are shown, however it is contemplated that many sections can be used with power system 20. Further, other seating systems that are known in the art can be used with power system 20. Thus, the seating disclosed herein is for illustrative purposes only, and is not intended to be unnecessarily limiting.

Sections 21A, 21B, 21C and etc. (FIGS. 1–2) include complementary components that are folded into each other, as are generally known in the art, and thus only section 21C is described hereinafter to reduce redundant discussion. Section 21C includes a bleacher-type seat 32C and a support structure 34C connected to seat 32C. Support structure 34C includes roller assemblies 36C, vertical beams 38C supported on roller assemblies 36C, and horizontal beams 40C supported on vertical beams 38C for supporting seats 32C. At least one pair of spaced vertical beams 38C are interconnected by diagonal strips 42 and 44 (FIGS. 3–4) which form an "X" shaped pattern. Strips 42 and 44 are interconnected at their intersection by a pin to stabilize structure 34C. Roller assemblies 36C include an inverted elongated U-shaped channel with multiple rollers 50C operably mounted therein. A guide 52C extends over a rib on the top of an adjacent roller assembly (36B) for retaining the adjacent roller assembly 36B and 36C in a parallel and adjacent relationship as the seating 21 is extended and retracted. A front cross beam 54 is attached to the front of telescopic seating 21 in front of roller assemblies 36A. Cross beam 54 holds a kick panel along the front row of seating 21, and further provides structure for attachment to the front end 25' of extendable chain 25.

The focus of the present invention is in power system 20. As noted above, power system 20 (FIG. 9) includes the frame 22, the carrier 23, the rotatable drum 24 and the extendable chain 25. Frame 22 (FIG. 9) is box-shaped and includes four vertical comer posts 58–61 rigidly interconnected by bracing 62 at the top, and a bottom plate 64 and a pair of L-shaped reinforcement side beams 66 at the bottom. L-shaped beams 66 extend fore-to-aft along the bottom of each side of frame 22, and interconnect the front and rear corner posts 58 and 60 on one side and the front and rear corner posts 59 and 61 on the other side. L-shaped beams 66 include forwardly facing sections 70 (FIG. 11) that define a mouth 72 on the front side 68 of frame 22 for receiving or expending extendable chain 25 from drum 24 along floor 28. The rear ends 74 of L-shaped beams 66 are interconnected by a bracket 76.

A chamber 78 (FIG. 10A) for enclosing drum 24 and for receiving extendable chain 25 is formed by a sheet metal housing 80 attached to frame 22. Housing 80 includes a central portion 82 and front and rear box-shaped portions 84 and 86, respectively. Front housing portion 84 is attached to front corner posts 58 and 59 and extends forwardly, and rear housing portion 86 is attached to rear corner posts 60 and 61 and extends rearwardly. A box-shaped side cover 90 (FIG. 5A) is attached to the corner posts 58 and 60 on one side of frame 22 and another box-shaped side cover 92 is attached to the corner posts 59 and 61 on the other side of frame 22. Box-shaped covers 90 and 92 define recesses for receiving the structure that protrudes from the sides of power mechanism 26 beyond frame corner posts 58 and 60 on one side and beyond corner posts 59 and 61 on the other side, as discussed hereinafter.

Figure 7:
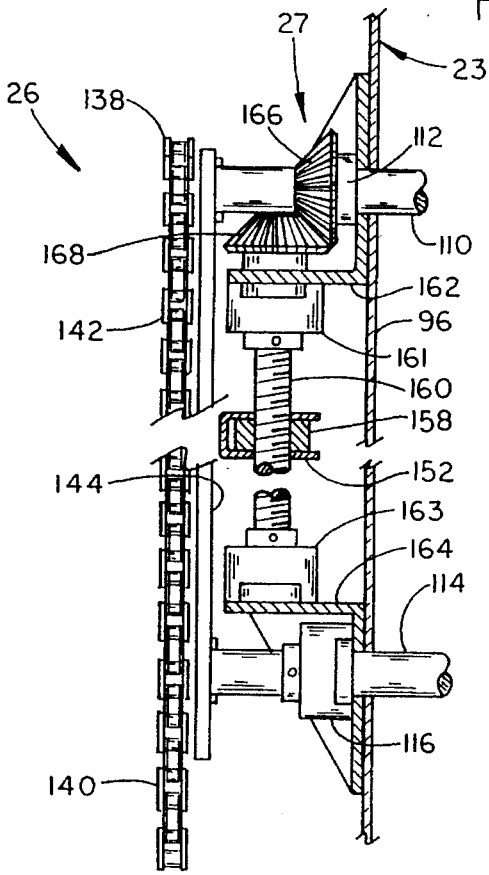
FIG. 7 is an enlarged fragmentary rear elevational view of the left portion of the power mechanism shown in FIG. 6 for lifting and rotating the drum.
Figure 8:
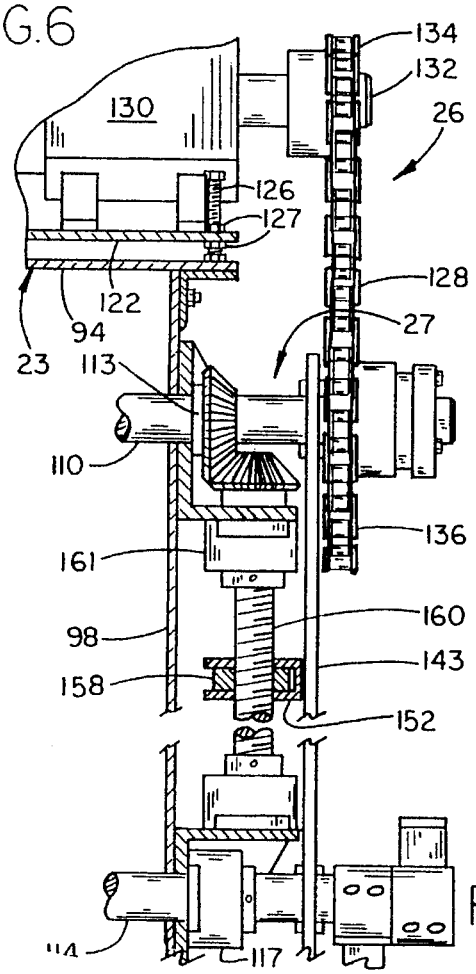
FIG. 8 is an enlarged fragmentary rear elevational view of the right portion of the power mechanism shown in FIG. 6 for lifting and rotating the drum.
Figure 14:
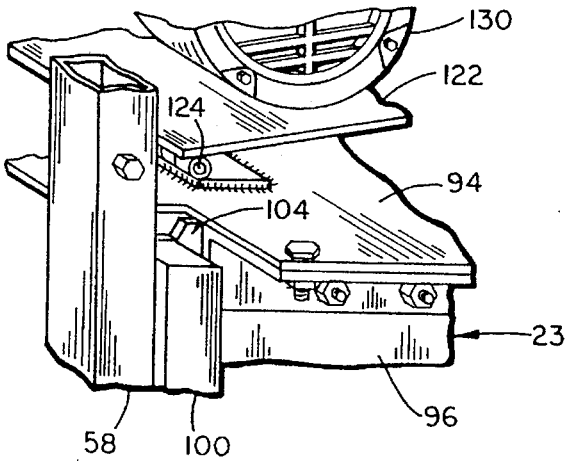
FIG. 14 is a fragmentary perspective view of the carrier guide and mating track on the frame.

The carrier 23 (FIG. 9) includes an upper platform 94, and side panels 96 and 98 (FIG. 10) that extend downwardly from platform 94 generally between corner posts 58 and 60 and between corner posts 59 and 61, respectively. A pair of opposing vertically extending guides or tracks 100 and 102 (FIG. 9) are attached to opposing faces of posts 58 and 60, respectively. Carrier side panel 96 :includes flanges 104 along its front and rear edges for engaging guides 100 and 102. A pair of opposing vertically extending guides 100 and 102 are also attached to posts 59 and 61, respectively (FIGS. 10 and 14). Flanges identical to flanges 104 and 106 are attached to the other carrier side panel 98. Thus, carrier 23 is guided vertically within chamber 78 of frame 22. An intermediate power transmitting drive shaft 110 (FIGS. 6–8) is extended between carrier side panels 96 and 98 and is rotatably supported on the side panels 96 and 98 by bearings at locations 112 and 113. A drum-supporting power transmitting drive shaft 114 is also extended between carrier side panels 96 and 98 at a location spaced below intermediate shaft 110. Drum-supporting shaft 114 is supported by bearings 116 and 117 on the side panels 96 and 98.

Drum 24 (FIG. 10B) is an octagonally-shaped structure defining a plurality of flat sides 181–188 around its perimeter for mateably receiving the links in chain 22. Drum 24 is narrow enough to fit between the carrier side panels 96 (and 98) (FIGS. 10–11). Two end panels 118 and 119 (FIG. 10B) form the ends of drum 24. An anchor or side-defining member 120 is attached to one of the flat sides between the two end panels 118 and 119 for connection to chain 25, as described below. Additional side-defining members are connected between end panels 118 and 119 as required to form the rigid structure of drum 24. End panels 118 and 119 of drum 24 are fixedly secured to drum-supporting shaft 114 for rotation within frame 22. Further, as described more fully below, drum 24 and carrier 23 are configured to move vertically as a unit within frame 22 as extendable chain 25 is wound onto and off from drum 24.

Figure 13:
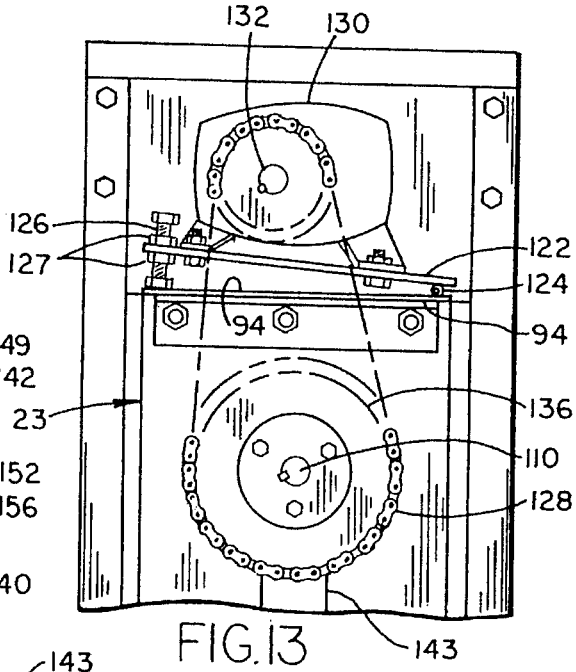
FIG. 13 is an enlarged fragmentary elevational view of the motor drive chain and chain tensioning system for the motor drive chain.

Power mechanism 26 (FIGS. 6–8) is configured to rotate drum 24 and further is configured to lift or lower drum 24 as the extendable chain 25 is wound onto or unwound from the drum 24, respectively. Specifically, power mechanism 26 includes a motor platform 122 pivotally connected to the top of carrier upper platform 94 by a hinge 124 (FIG. 13). A reversible electric motor 130 (having a horsepower rating of about ¼ hp for about 14 rows) is secured to motor platform 122, and a control 131 (FIG. 10) for operating motor 130 is connected to motor 130. Motor 130 includes a rotatable shaft 132 that extends laterally over carrier side panel 98, and a sprocket 134 is secured to a protruding end of shaft 132 below shaft 132. A second sprocket 136 is attached to a first end of intermediate power transmitting shaft 110, and the drive chain 128 is connected between motor sprocket 134 and second sprocket 136. A bolt 126 (FIG. 8) extends through motor platform 122 generally perpendicularly against carrier upper platform 122. The bolt 126 is spaced laterally from hinge 124, and by adjusting lock nuts 127 on bolt 126, the angle of motor platform 122 can be adjusted on carrier upper platform 122. This adjusts the tension in upper drive chain 128.

Figure 12:
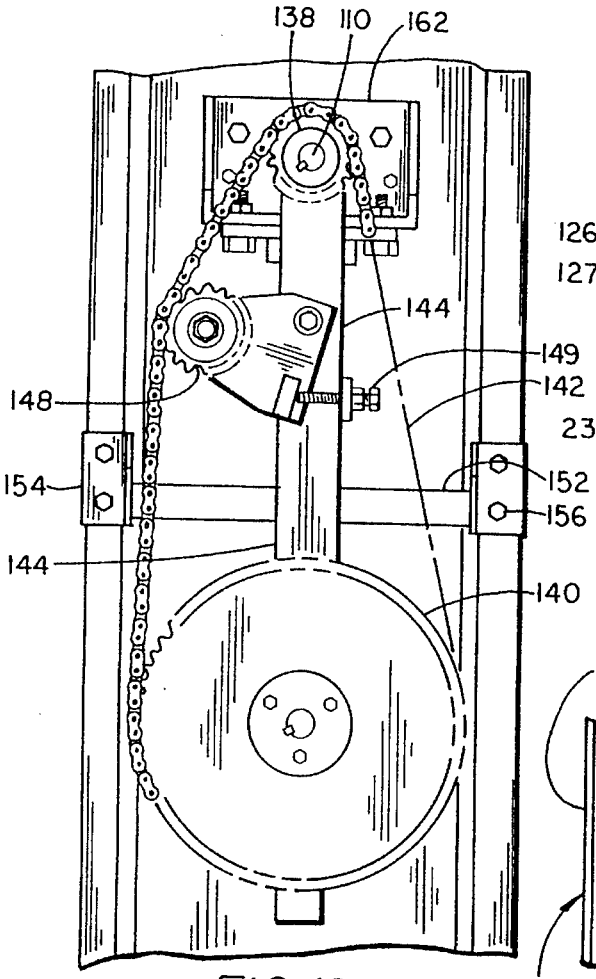
FIG. 12 is an enlarged fragmentary elevational view of the intermediate drive chain and chain tensioning system for the intermediate drive chain.

A third sprocket 138 (FIG. 6) is secured to an opposite end of intermediate power transmitting shaft 110 opposite second sprocket 136, and a fourth sprocket 140 is secured to an end of drum-supporting shaft 114 located below third sprocket 138. A drive chain 142 is extended around sprockets 138 and 140. Spacer bars 143 and 144 are secured between power transmitting shafts 110 and 114 on opposite ends thereof to further support the ends of shafts 110 and 114 in order to maintain the spacing between shafts 110 and 114. A tensioner 146 (FIGS. 11–12) including a free wheeling sprocket 148 and an adjustable bolt 149 is attached to the spacer bar 144. By adjusting bolt 149, free wheeling sprocket 148 presses laterally against drive chain 142. Thus, the tension on drive chain 141 can be adjusted. Drum 24 (FIG. 6) is rotated by power transmitted from motor: 130 through drive chain 128, intermediate shaft 110, drive chain 142 and drum-supporting shaft 114 to drum 24. By selectively reversing motor 130, drum 24 can be rotated to extend/unwind extendable chain 25 or rotated to retract/wind extendable chain 25.

Figure 15:
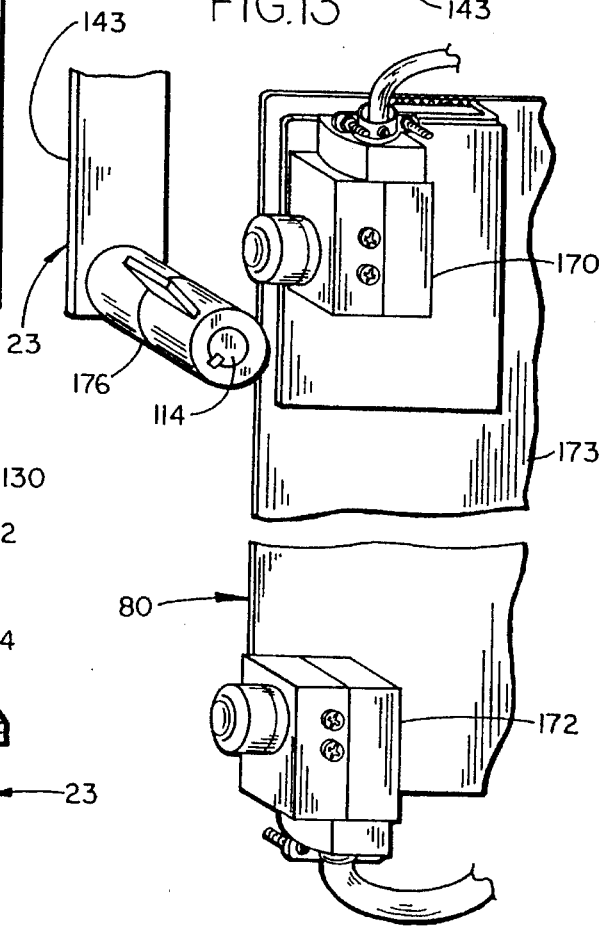
FIG. 15 is a fragmentary perspective view of the limit switch arrangement for sensing and controlling the upper and lower position of the carrier.
Figure 16:
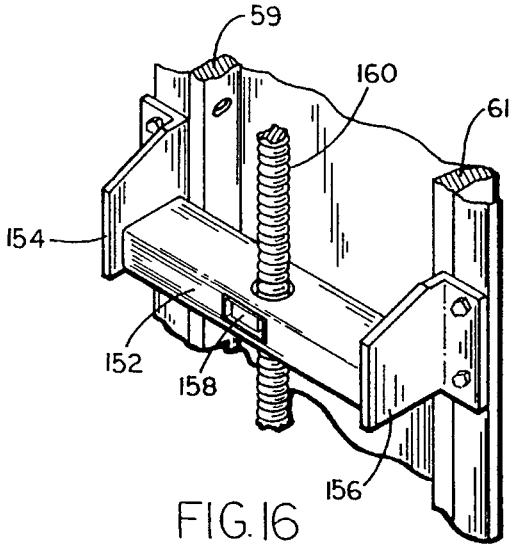
FIG. 16 is a fragmentary perspective of the lift mechanism including the threaded lift shaft and the lift shaft engaging member secured to the frame.

The lift mechanism 27 (FIG. 6) of power mechanism 26 is configured to lift carrier 23, including drum 24 and any portion of extendable chain 25 that is wound onto drum 24, at a predetermined controlled rate. Lift mechanism 27 includes opposing structures that are generally identical on both sides of carrier 23, and thus only the left side is described hereinafter to reduce redundant discussion. Lift mechanism 27 includes a horizontal brace 152 (FIGS. 9 and 16) secured to front and rear corner posts 59 and 61 by "L" brackets 154 and 156 at a location spaced above floor 28. Horizontal brace 152 is located at a predetermined height so that it is located below the lowermost travel of intermediate shaft 110 and above the uppermost travel of drum-supporting shaft 114. A nut 158 is secured to brace 152, and a threaded lift shaft 160 is threadably extended through nut 158. Threaded lift shaft 160 (FIGS. 6–8) is rotatably supported at its upper end on carrier 23 by a bearing 161 located on a bracket 162 secured to bracket 116 of carrier side panel 96 adjacent intermediate shaft 110, and is rotatably supported at its lower end on carrier 23 by a bearing 163 located on a bracket 164 secured to carrier side panel 96 adjacent drum-supporting shaft 114. A beveled gear 166 is secured to intermediate shaft 110 and a mating beveled gear 168 is secured to the top end of shaft 160. Beveled gears 166 and 168 matingly engage so that lift shaft 160 mateably rotates with intermediate shaft 110. Since lift shaft 160 threadably engages nut 158 which is fixed to frame 22, the rotation of lift shaft 160 forces carrier 23 (including lift shaft 160) to move upwardly or downwardly, depending on the rotation of intermediate shaft 110. Upper and lower limit switches 170 and 172 (FIGS. 10 and 15) are supported on a bracket 173 attached to corner post 61. A trip bracket 176 for actuating switches 170 and 174 is attached to spacer bar 143. As carrier 23 is moved vertically, trip bracket 176 engages limit switches 170 and 172 to set the upper and lower limits for movement of carrier 23. Concurrently, this also determines the maximum extension and retraction of extendable chain 25.

Drum 24 (FIG. 10B) defines eight flat sides 181–188 arranged in a spiral-type arrangement that are particularly configured to receive links 300–340 of extendable chain 25. It is noted that an alternative number of sides can be used if desired. The eight sides 181–188 define an increasing radial distance relative to the axis defined by drum-supporting shaft 114, such that the "last" end of the eighth side 188 is spaced radially from the "front" end of the first side 181 by a radial distance D1. Radial distance D1 is equal to the thickness of the extendable chain 23. The sides 181–188 have an equal length L1. The first eight links 300–307 in extendable chain 25 define a first wrap W1. Links 300–307 each have a length L1 so that they mateably engage sides 181–188 when wound onto drum 24. The next eight links 308–315 on the second wrap W2 around drum 24 each have a longer length L2. The lengths on successive wraps W3 (links 316–323), W4 (links 324–331), and W5 (links 332–339) are chosen so that extendable chain 25 mateably wraps onto drum 24 in successive layers as shown in FIG. 10A.

The lift mechanism 27 (FIGS. 6–8) and in particular the beveled gears 166 and 168 and the threaded lift shaft 160 are configured to raise carrier 23 the distance D1 of extendable chain 25 upon each 360° rotation of drum 24. Thus, the distance from floor 28 to the drum-supporting shaft 114 varies at a coordinated rate such that the bottommost link 190 (FIG. 10A) being pushed off from (or wound onto) drum 24 is always substantially at floor level and aligned with the extended portion of extendable chain 25. Optimally, the wheels 210 on each of the links in extendable chain 25 are at the "rear" end of the links so that bottommost link 190 being pushed off of drum 24 rollingly engages floor 28. This prevents the links from being forced into the floor.

Figure 17:
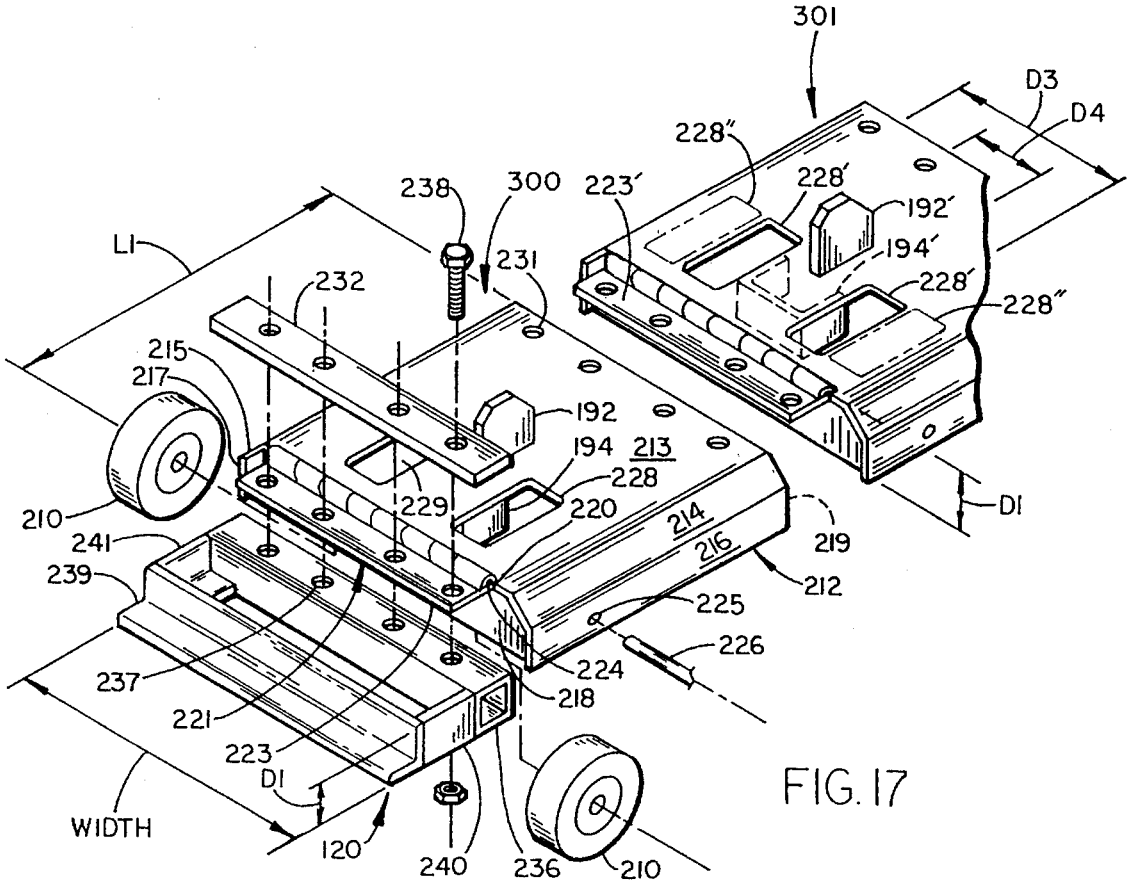
FIG. 17 is an exploded perspective view of a pair of links in the extendable chain including the anchoring member on the drum.

The links 300–342 (FIG. 10A) are generally identical except as noted hereinafter, and thus only, links 300 and 301 are shown in FIG. 17 for illustrative purposes. Link 300 includes a concave body 212 (FIG. 17) with wheels 210 operably mounted thereon. The cross-sectional shape (i.e. the width and depth) of each body 212 is the same, however, the length (e.g. length L1) of each body 212 varies from one wrap to another as discussed above. Body 212 has an inverted "U" shaped cross section, and includes a flat upper wall 213, angled webs 214 and 215 extending from the sides of upper panel 213, and sidewalls 216 and 217 extending from angled walls 214 and 215, respectively. A front reinforcement wall 218 and a rear reinforcement wall 219 are welded to the underside of walls 213–217 at locations spaced inwardly from the front and rear of body 212. A notch 220 is cut in the rear of upper wall 213. A "piano" hinge 221 includes a first hinge member welded or otherwise secured to body 212 and a second hinge member 223 pivotally secured to the first hinge member by a hinge pin 224 located generally in notch 220. A hole 225 is located on each sidewall 216 and 217 near reinforcement wall 218, and an axle 226 is extended through holes 225 into wheels 210 to support wheels 210 under body 212. An alignment tab 192 extends upwardly from upper wall 213. A U-shaped structure 194 is welded under wall 213. U-shaped structure 194 captures tab 192 of the piggy backed link on an adjacent wrap when chain 25 is wound onto drum 24. Also, mouth 72 includes a slot (not specifically shown) for guiding tab 192 to in turn guide each link as it enters (or leaves) mouth 72 during extension/retraction of chain 25.

Wheels 210 have a diameter significantly larger than the dimension D1, the thickness of body 212, such that wheels 210 extend below the lower edge 227 of sidewalls 216 and 217. A pair of rectangular apertures 228 and 229 are located in upper wall 213 for receiving the protruding part of wheels 210 on an adjacent "piggy backed" link in an adjacent wrap. This creates an alternating arrangement where the wheels 210 mateably nest adjacent each other in successive wraps. For example, see the links in FIGS. 5A and 10A. In the first wrap (i.e. links 300–307), the wheels 210 are spaced a distance D3 apart, while the apertures 228 and 229 are spaced a distance D4 apart. In the second wrap (i.e. links 308–315) the wheels 210 are spaced the distance D4 apart, while the apertures (228" and 229") are spaced the distance D3 apart. For purposes of illustration, the apertures (228" and 229") for links 308–315 are shown in phantom on link 301 in FIG. 17 and are designated by the numbers 228" and 229". This alternating pattern continues throughout successive wraps. Thus, the protruding portion of wheels 210 in links 300–307 of the first wrap W1 fits mateably into apertures 228 and 229 in the adjacent links 308–315 of the second wrap W2 when wound onto drum 24. Also, the wheels 210 on wrap W3 nest into holes 228" and 229" in wrap W2. The same alternating arrangement is continued for wraps W3 and W4, and for wraps W4 and W5. This allows use of large wheels 210 on extendable chain 25, yet allows a relatively densely packed arrangement to be formed on drum 24. Notably, wheels 210 can be held at the correct spacing on axle 226 in a number of ways, such as by press-fitting wheels 210 onto axle 226. Alternatively, sleeves can be placed between the wheels 210. The U-shaped structure 194 welded under upper wall 213 is located generally between apertures 228 and 229 and reinforces upper wall 213. A pattern of holes 231 are formed near the leading end of body 212 for attaching to the hinge member 223' on an interconnected adjacent link body 212'. A reinforcement plate 232 can be used to more securely attach hinge 223 to the adjacent body 212 if desired.

Drum 24 includes a connection/driving anchor bracket 120 (FIG. 17) for connection to the first link 300 of chain 25. Bracket 235 includes a square robe 236 with holes 237 configured to mateably engage hinge member 223 of link 300. A reinforcement plate 232 is connected to square tube 236 by bolts 238 with hinge member 223 sandwiched therebetween. Square tube 236 is anchored to drum 24 by a transverse angle beam 239 and a pair of circumferentially extend short angle beams 240 and 241. The outermost link 342 (FIG. 10A) is connected to the front cross beam 54 of telescopic seating by a bracket that includes an apertured flange not unlike hinge member 223.

Notably, since the outermost link connected to from cross beam 54 has the same width as the innermost link connected to drum 24, and since all links align and mateably nest and engage, extendable chain 25 more uniformly distributes stress along its length. This contrasts with many prior art extendable claims that have a narrow outermost links that is subject to failure the outermost point typically experiences the highest stress.

In operation, telescopic seating 21 is initially in a closed/retracted position (FIG. 2) and chain 25 is substantially fully wound onto drum 24. Further, carrier 23 holds drum 24 in a raised position. Motor 130 of power mechanism 26 is actuated to rotate drum 24 to extend chain 25. As chain 25 is extended, it is expended from drum 24 along floor 28, thus forcing the individual sections 21A, 21B, 21C and telescopic seating 21 to telescopingly separate. As drum 24 is rotated, it is also lowered by carrier 23 so that the chain 25 is continuously tangentially aligned with the remaining portion of chain 25 still wound on drum 24. To retract telescopic seating 21, the drum 24 is reversibly rotated. Simultaneously, carrier 23 lifts drum 24 to make room for each link in the chain 25 as it is wound onto drum 24.

In the foregoing description, it will be readily appreciated by those skilled in the art that modifications may be made to the invention without departing from the spirit of the present invention and the concepts disclosed herein. Such modifications are to be considered as included in the following claims, unless these claims by their language express state otherwise.

The embodiments of the invention in which an exclusive property or privilege is claimed are defined as follows:

1. A power system for extending and retracting telescopic seating systems, comprising:

a frame;

a drum operably supported on said frame for rotational and vertical movement;

an extendable chain adapted for connection to a telescopic seating system to extend and retract the telescopic seating system, said chain being configured to selectively mateably wind onto and off from said drum as said drum is being rotated, said chain having a thickness such that successive wraps of said chain on said drum have an increased diameter; and a power mechanism operably attached to said frame and to said drum, said power mechanism being configured to rotate said drum to selectively extend and retract said extendable chain, said power mechanism further being configured to raise and lower said drum as said extendable chain is retracted and extended, respectively, so that an extended portion of said chain is substantially continuously tangentially aligned with a wound portion of said chain on the drum as said chain is selectively retracted and extended.

2. A power system as defined in claim 1 including a carrier movably mounted on said frame and rotatably supporting said drum.

3. A power system as defined in claim 2 including a motor operably attached to said carrier for rotating said drum.

4. A power system as defined in claim 3 including a lift mechanism operably connected to said motor for lifting said carrier.

5. A power system as defined in claim 4 wherein said lift mechanism includes a threaded shaft and threaded-shaft-engaging nut.

6. A power system as defined in claim 5 wherein said motor has a horse power rating of about ¼ hp or more.

7. A power system as defined in claim 6 wherein said extendable chain has a length sufficient to extend a telescopic seating system at least about 14 rows.

8. A power system as defined in claim 1 wherein said power system includes a lift mechanism for lifting said drum.

9. A power system as defined in claim 8 including a motor operably connected to said lift mechanism to lift said drum and further operably connected to said drum to rotate said drum.

10. A power system as defined in claim 9 wherein said lift mechanism includes a threaded lift shaft and lift-shaft-engaging nut.

11. A power system as defined in claim 1 including limit switches on said frame operably connected to said power mechanism to limit the maximum travel of said drum.

12. A power system as defined in claim 1 wherein said power mechanism includes a motor having a power rating of ¼ hp or more and wherein said extendable chain has a length sufficient to extend a telescopic seating system up to 30 rows.

13. A power system as defined in claim 1 wherein said power mechanism includes a motor platform operably mounted to said frame, a motor mounted on said motor platform and a drive chain connecting said motor to said drum, said motor platform being pivotable to adjust the tension on said drive chain.

14. A power system as defined in claim 13 including a carrier slideably mounted on said frame, said motor platform being pivotally secured to said carrier.

15. A power system as defined in claim 1 wherein said extendable chain includes a plurality of interconnected links, each of said links including a pair of wheels for supporting said links movably on a support surface, said plurality of interconnected links including a first set of links forming a first wrap on said drum, a second set of links forming a second wrap on said drum, and additional alternating odd and even wraps corresponding to said first and second wraps, respectively, said pair of wheels on the links on successive wraps nesting adjacent each other in an alternating arrangement when said plurality of interconnected links are wound onto said drum.

16. A power system for an extendable chain, comprising:

a drum configured to receive and expend an extendable chain to retract and extend the chain, respectively;

a frame supporting said drum for rotational and translational movement; and a power mechanism operably mounted on said frame and operably connected to said drum for rotating said drum and for raising and lowering said drum, said power mechanism being configured to rotate said drum to form successive wraps of the chain on said drum and further being configured to raise and lower said drum as said successive wraps are wound and unwound onto said drum, respectively.

17. A power system as defined in claim 16 wherein said frame includes a mouth for guiding the exit and entrance of the extendable chain from and onto said drum, respectively.

18. A power system as defined in claim 16 including a carrier movably mounted on said frame and rotatably supporting said drum.

19. A power system as defined in claim 18 including a motor operably attached to said carrier for rotating said drum.

20. A power system as defined in claim 16 wherein said power system includes a lift mechanism for lifting said drum, and a motor operably connected to said lift mechanism to lift said drum and further operably connected to said drum to rotate said drum.

21. A power system as defined in claim 16 wherein said power system includes a lift mechanism for lifting said drum and said lift mechanism includes a threaded lift shaft.

22. A power system as defined in claim 16 wherein said power mechanism includes a motor platform operably mounted to said frame, a motor mounted on said motor platform and a drive chain connecting said motor to said drum, said motor platform being pivotable to adjust the tension on said drive chain.

23. A power system as defined in claim 16 including an extendable chain operably connected to said drum.

24. A power system as defined in claim 23 wherein said extendable chain includes a plurality of interconnected links, each of said links including a pair of wheels for supporting said links movably on a support surface, said plurality of interconnected links including a first set of links forming a first wrap .on said drum, a second set of links forming a second wrap on said drum, and additional alternating odd and even wraps corresponding to said first and second wraps, respectively, said pair of wheels on the links on successive wraps nesting adjacent each other in an alternating arrangement when said plurality of interconnected links are wound onto said drum.

25. A telescopic seating apparatus comprising:

telescopic seating;

a power system for extending and retracting said telescopic seating; and an extendable chain including a first end operably attached to said telescopic seating and a second end operably attached to said power system;

said power system comprising:

a frame;

a drum for winding said extendable chain, said drum being rotationally and translatably supported on said frame; and a power mechanism for rotating said drum and for raising said drum, said power mechanism being configured to rotate said drum to wrap said extendable chain onto said drum and further being configured to raise said drum as said extendable chain is wound onto said drum and takes up space thereon and still further being configured to lower said drum as said extendable chain is unwound from said drum and takes up less space thereon.

26. A telesceopic seating apparatus as defined in claim 25 wherein said extendable chain has a length sufficient to extend a telescopic seating system up to 30 rows.

27. A telescopic seating apparatus as defined in claim 26 including a carrier movably mounted on said frame and rotatably supporting said drum, a motor operably mounted on said carrier for rotating said drum, a lift mechanism operably connected between said carrier and said frame and operably connected to said motor, said lift mechanism including a threaded lift shaft.

28. A telescopic seating apparatus as defined in claim 27 wherein said motor has a horse power rating of ¼ hp or more.

29. A seating apparatus comprising:

telescopic seating;

a power mechanism including a drum for extending and retracting said telescopic seating; and an extendable chain including a first end operably attached to said telescopic seating and a second end operably attached to said drum; and said extendable chain including a plurality of interconnected links having a substantially equal width so that an outermost link at said first end is substantially equal in strength to an innermost link at said second end, said plurality of interconnected links including a first set of links forming a first wrap on said drum, a second set of links forming a second wrap on said drum, and additional alternating odd and even sets of links forming odd and even wraps corresponding to said first and second wraps, respectively, said first set of links on said first wrap and said additional sets of links forming said odd wraps including first wheels located in a first position, and said second set of links on said second wrap and said additional sets of links forming said even wraps including second wheels located in a second position, said first and second positions being such that said first and second wheels nest adjacent each other in an alternating arrangement when said plurality of links are wound onto said drum.

30. A seating apparatus as defined in claim 29 including third wheels spaced from said first wheels on said first wrap and further including fourth wheels located on said second wrap, said first and third wheels being spaced apart, and said second and fourth wheels being spaced apart.

31. A seating apparatus as defined in claim 30 wherein said first and third wheels are spaced a first predetermined distance apart and said second and fourth wheels are spaced a second predetermined distance apart, said first predetermined distance being different than said second predetermined distance.

32. A seating apparatus as defined in claim 31 wherein each of said links includes a back plate, said back plate including apertures for receiving one of said first and third wheels, and said second and fourth wheels.

33. A power system comprising:

an extendable chain including a plurality of interconnected links that can be wound in a spiral in a first direction but that cannot bend in an opposite direction;

a drum configured to receive the extendable chain as the chain is retracted and extended, said drum including a first sprocket secured thereto;

a frame operably supporting said drum; and a power mechanism configured to rotate said drum to form successive wraps of the chain on said drum, said power mechanism including a motor platform pivotally attached to said frame, a motor mounted on said motor platform including a drive sprocket, a chain drive extending between said drive sprocket and said first sprocket, and a tension adjustment mechanism for adjusting the tension in the chain drive by pivotally moving said motor platform relative to said frame.

34. A power system as defined in claim 33 wherein said motor of platform is pivotally attached on one side and including an angle adjusting member located on an opposite side of said motor platform.

35. A power system as defined in claim 34 including a carrier, said motor of platform being pivotally connected to said carrier, said carrier being slideably mounted on said frame.

36. A power system as defined in claim 35 wherein said drum is rotatably secured to said carrier.

37. A power system for extending and retracting telescopic seating systems, comprising:

a frame including a mouth located proximate a support surface for said frame;

a drum;

first means on said frame for operably supporting said drum and for rotating said drum;

an extendable chain adapted for connection to a telescopic seating system to extend and retract the telescopic seating system, said chain being configured to selectively mateably wind onto and off from said drum as said drum is being rotated, said chain having a thickness such that successive wraps of said chain on said drum have an increased diameter;

second means operably connected to said frame for delivering said extendable chain tangentially from said drum to said mouth on said frame; and a power mechanism operably attached to said first and second means, said power mechanism being configured to rotate said drum to selectively extend and retract said extendable chain.

38. A power system as defined in claim 37 wherein said first and second means include a carrier movably mounted on said frame and rotatably and translatably supporting said drum.

* * * * *